United States Patent [19]

Ashton

[11] Patent Number: 4,685,973

[45] Date of Patent: Aug. 11, 1987

[54] RECLAMATION OF FOUNDRY SANDS

[75] Inventor: Michael C. Ashton, Sheffield, England

[73] Assignee: Steel Castings Research and Trade Association, Sheffield, England

[21] Appl. No.: 696,282

[22] Filed: Jan. 30, 1985

[30] Foreign Application Priority Data

Feb. 3, 1984 [GB] United Kingdom ..... 8402856
Oct. 29, 1984 [GB] United Kingdom ..... 8427335

[51] Int. Cl.[4] ..... B08B 7/04

[52] U.S. Cl. ..... 134/13; 134/19; 134/21; 134/25.1; 134/30; 134/36; 164/5; 210/732

[58] Field of Search ..... 164/5; 134/10, 13, 19, 134/21, 25.1, 28–30, 32, 36, 37, 2; 210/732

[56] References Cited

U.S. PATENT DOCUMENTS 2,766,496 10/1956 Ward ..... 164/5
3,436,260 4/1969 Duff ..... 134/37
3,716,780 2/1973 Finley et al. ..... 210/104
4,113,510 12/1978 Richard ..... 134/29
4,144,088 3/1979 Adams ..... 134/19
4,303,453 12/1981 Jung et al. ..... 134/25.1

FOREIGN PATENT DOCUMENTS 56-40657 9/1981 Japan ..... 164/5
8200155 8/1983 Netherlands ..... 134/25.1

*Primary Examiner*—Peter Hruskoci
*Attorney, Agent, or Firm*—Caesar, Rivise, Bernstein & Cohen

[57] ABSTRACT

A used foundry sand, especially one which has been bonded using sodium silicate binder, is reclaimed by agitating the sand with water in a plenum chamber having a suspended floor comprising a porous membrane, stopping the agitation and allowing the solids to settle on the floor. The water passes through and the sand settles on the floor, and the finer particles may then be removed e.g. by air elutriation. Preferably the water mixed with the sand has a pH below 10 and contains a flocculant, and the water recovered from the vessel has suspended solids content below 500 mg/liter.

12 Claims, 6 Drawing Figures

RECLAMATION OF FOUNDRY SANDS

Figure 1:
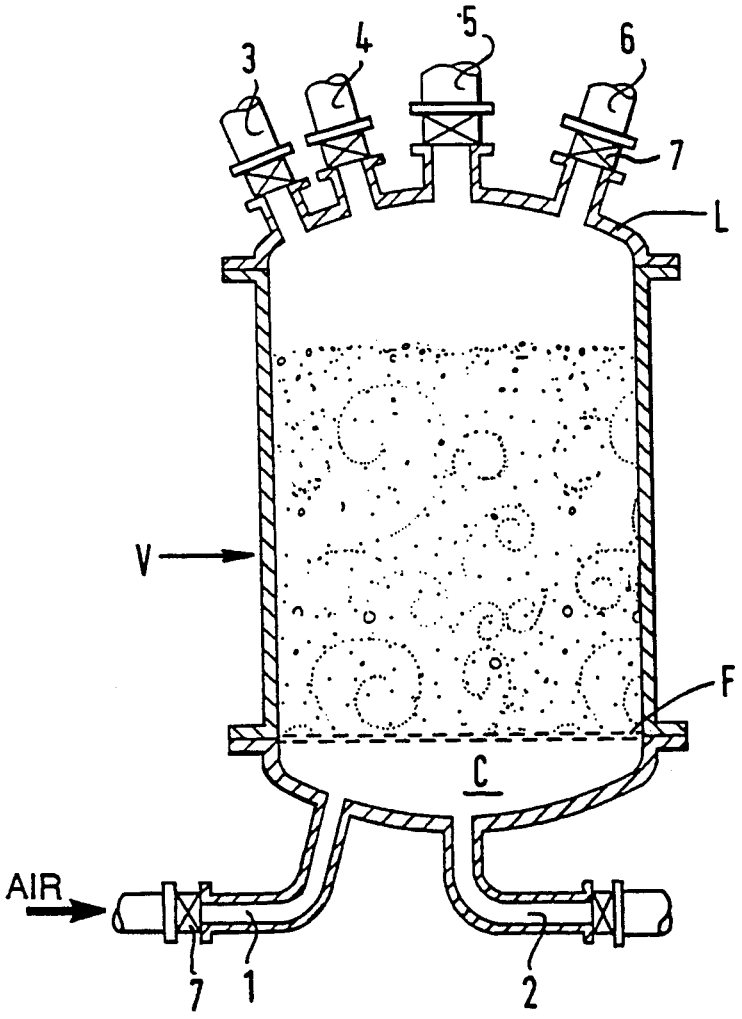

This invention relates to the reclamation of bonded particulate material, typically sand, from a mould following casting of an article of molten metal in the mould. The invention is of especial value in the reclamation of particulate material when the binding agent for the particulate material is sodium silicate. Sodium silicates are popular agents because they are readily available, relatively cheap and are non-toxic and pollution free. They form very effective bonds with all types of sands and the bonded sand is rapidly hardened in situ by the passage of $CO_2$ gas or self-set by the inclusion of organic esters in the sand mix. The moulds and cores so produced are accurate, rigid and stable and a very satisfactory casting quality is obtained in the foundry. However, sodium silicate bonded moulds consume considerable quantities of new sand. Whilst economies in new sand usage can be made by using a low sand to metal ratio in moulding, generally some 3 to 5 tonnes of new sand are used per tonne of steel castings produced.

Over recent years the cost of fresh silica sand has escalated, as has the cost for dumping rejected used sand. Moreover, dumping sites are becoming scarcer and new legislation is likely to impose further restrictions on the types of material acceptable for dumping.

Sands bonded with organic resin binders are now conventionally reclaimed by dry methods and such reclaimed sands give satisfactory foundry performance even at high levels of re-use, e.g. over 80%. Such dry reclamation processes may be used to reclaim sodium silicate bonded sands but the re-use level of the reclaimed sand is normally limited to about 50%. Known methods for the wet reclamation of sodium silicate bonded sands give a higher quality product but the plants are complex with high capital operations and maintenance costs, and create effluent disposal problems requiring additional expensive plant for the treatment of the effluent. The municipal and other authorities are becoming more strict in the definition of waste they are prepared to accept.

Used sodium silicate bonded sands contain:

| | |
|---|---|
| $CO_2$ hardened sands | |
| Unreacted sodium silicate | some dehydrated |
| Hydrogel silica bond | some dehydrated |
| Sodium carbonate and bicarbonate | |
| Organic materials, e.g. sugars and their breakdown products | |
| Ester hardened sands | |
| Unreacted sodium silicate | some dehydrated |
| Silica gel bond | some dehydrated |
| Unreacted ester | |
| Alcohol and acid (sodium salt) | |
| Organic materials and their breakdown products | |

Many of these residues are readily soluble in water but where the sand has been moderately heated—above about 600° C.—the bond fuses to form stable and insoluble degradation products which adhere firmly to the sand grains. Where the sand has been heated to high temperatures (close to the metal/mould interface) the sodium silicate bond is strongly fused and attack of the silica sand grains will occur promoting conversion to tridimite and cristobalite.

Reclamation in the full sense is therefore more difficult with sodium silicate than any other type of binder used in the foundry. It has however been realised that reclamation is desirable and various techniques both dry and wet have been tried to achieve this. So far as we are aware no technique is wholly successful in terms of the economic advantage coupled with the need to produce waste water which may be discharged to main drains, sewers or streams without causing pollution or other hazard.

It is one object of this invention to offer a way of reclaiming chemically bonded particulate material and providing re-usable particulate material and relatively safe by-products. The term re-usable particulate material means material, typically sand, which has been reclaimed such that it is substantially equivalent in cleanliness, grain size and absence of fines to the corresponding new sand. Total purity is very difficult and expensive to attain and in practical terms it is not necessary: reclaimed material which needs only moderate (10 to 20%) dilution with new material when repeatedly re-used and reclaimed is sufficient. The term relatively safe by-products means water which may be discharged directly to a municipal water system according to the local legal requirements. In general one requires water with a solids in suspension, measured at pH 7, below 500 mg/liter and a pH in the range of between 5 and 10.

According to a first aspect of the invention there is provided a method of claiming for re-use silicate bonded particulate material which has been in contact with molten metal, e.g. when shaped into a foundry casting mould, the method comprising crushing the used material to grain size, mixing the material with water, and agitating the mixture to cause the water-soluble derivatives to be removed to be scrubbed off the grains characterised in that (a) the grains and water are placed in a vessel having a plenum chamber at the base and a suspended floor comprising a porous membrane,
(b) the mixture is subjected to the agitation,
(c) the agitation is stopped and the solids are allowed to settle on the porous membrane floor to form a bed comprising denser particles of particulate material on the membrane and finer particles on top of the denser particles,
(d) the water is withdrawn from the vessel via the bed which retains the fine particulate material, and
(e) the fine particulate material is separated from the sand.

Because the water is removed from the vessel by passage through the layer of particulate material and fine particles, the water has a suspended solids content of below about 500 mg/liter.

According to a second aspect of the invention there is provided a method of treating used silicate bonded particulate material containing water soluble derivatives to be removed so as to yield particulate material which may be reused and water which may be discharged to a municipal waste outlet, the method being as defined above and further characterised in that the alkalinity of the water added to the particulate material is adjusted to facilitate the removal of derivatives to be removed and to ensure that it is of the correct pH for the disposal, preferably by the addition of acid, until the pH of the added water is below 10.

Because the acidity of the water is adjusted, the removal of the derivatives to be removed, typically sodium derivatives, is more efficient, the rate of cleaning is improved and the acidity of the extracted water is more suitable for discharge to a municipal waste outlet.

According to a more specific aspect of the invention there is provided a method as defined being further characterised by (i) adding water and the particulate material to the vessel in weight ratio of about 1:1 to about 3:1, the pH of the water having been adjusted to a value below 10, (ii) agitating the mixture for a sufficient time to dissolve the soluble derivatives from the particulate material, ceasing the agitation and allowing the material to settle as a bed on the porous membrane floor, (iii) withdrawing the water containing the soluble binder products from the material via the bed either under vacuum drawn through the porous membrane floor or by means of applied air pressure or both, and either using that water alone or with clean water for the next batch or discharging it to waste, (iv) adding clean water to the particulate material in weight ratio of about 1:1, agitating the mixture for sufficient time to free residual soluble binder products from the particulate material, (v) withdrawing the water containing the residual soluble binder products from the material and using that water in the primary washing treatment, (vi) drying and cooling the treated particulate material and removing very fine particulate material by air elutriation.

In a much preferred feature, heating elements are present in the vessel above the membrane so that they will be within the layer of the deposited particulate material, the material is washed and when the water has been drawn off the heating elements are energised and vacuum is applied so that the material is dried. The vacuum is removed and the material is fluidised to remove the very fine particles so providing directly dried and classified material ready for mixture with virgin particulate material.

The particulate material may be any sand or like material which has been chemically, i.e. silicate, bonded to form a foundry casting mould. The mould may have been used to cast an article of molten metal, e.g. steel, aluminium, iron.

A flocculant is preferably included in the particulate material/water mixture. The type of flocculant and the concentration thereof will depend to a large extent on the nature of the particulate material, i.e. sand being treated: for silica sands we have found that about 1 or 2 mg/liter of a non-ionic flocculant of high molecular weight is beneficial and for zircon sand about 30 mg/liter of a low molecular weight cationic flocculant is suitable. The presence of the flocculant tends to agglomerate the ultra fine particles to form a porous structure to the surface layer that is present on the bed of settled sand. The flocculant also helps to hold back ultra fine particles and to increase the rate of extraction of water.

The porous membrane is preferably formed of a material having a pore size less than 75 μm. Suitable materials include porous plastic, ceramic or sintered metal, woven metal or fibre cloth.

Most preferably the porous membrane is a suspended floor or baffle wall or weir which supports the water and particulate material. It is advantageous to charge the water into the vessel first and acidify it with an acidifying agent to keep the solution alkalinity below pH 10. The water and particulate material are preferably mixed in a water:material ratio of 2:1, dependant on the nature of the material.

The particulate material may be received in a variety of forms ranging from lumpy to granular. It is much preferred that before addition to the vessel, the material is reduced to grain size and this can be done by pressure jetting, mechanical attrition (wet or dry), or some other form of comminution. The material will typically be sodium silicate bonded sand and other materials may be present, e.g. breakdown agents.

The required agitation may be effected by mechanical agitation, tumbling or the like. It is a much preferred feature of the invention that agitation be effected by the use of compressed air, applied at a pressure of about 2 to 30 lb/in$^2$ (0.14 to 2.07 bar). The agitation may be carried out for a period ranging from about 5 to 20 minutes.

When agitation is over, the water is withdrawn through the porous membrane, preferably by the application of a vacuum or compressed air or both. Our evaluations suggest that a vacuum of the order of 15 inches Hg is sufficient to extract the majority of the water and this may be continued for a period of say 3 to 30 minutes. The extracted water will contain suspended solids which typically will be at an acceptable level for discharge to waste systems and have a pH of the required value. The withdrawn water may be used in part or whole for the treatment of the next batch of used particulate material or discharged to waste. Fine particulate material (minus 63 μm particles) is retained in the bed of particulate material and does not contaminate the withdrawn water. Our evaluations have shown that several factors affect the amount of suspended solids in the filtrate. Because of the agitation the solids are suspended in the water: if there is a time interval between the cessation of agitation and the withdrawal of the water, more suspended solids will tend to fall back on to the settled particulate material. For this reason it is important to relate the start of withdrawal of water to the cessation of the agitation according to the desired level of suspended solids in the filtrate. The depth of the bed of settled particulate material aids in determining the amount of fine particulate material retained in the bed and not withdrawn with the water. If it is necessary to keep the suspended solids content in the waste water very low, the depth of the bed should be increased, e.g. by using a vessel of a suitable shape.

The particulate material and water may be subjected to the agitation and extraction stages more than once to extract the soluble derivatives typically sodium salts. We have found that the same water may be used more than once but it is advantageous to use fresh water particularly at the secondary washing stage.

In the foregoing description the binder has been identified as sodium silicate but the invention is applicable to sands bonded with other water soluble binders such as potassium silicate.

The invention includes particulate material reclaimed by the method; mixtures of the reclaimed material with virgin material, and articles made therefrom.

Figure 2:
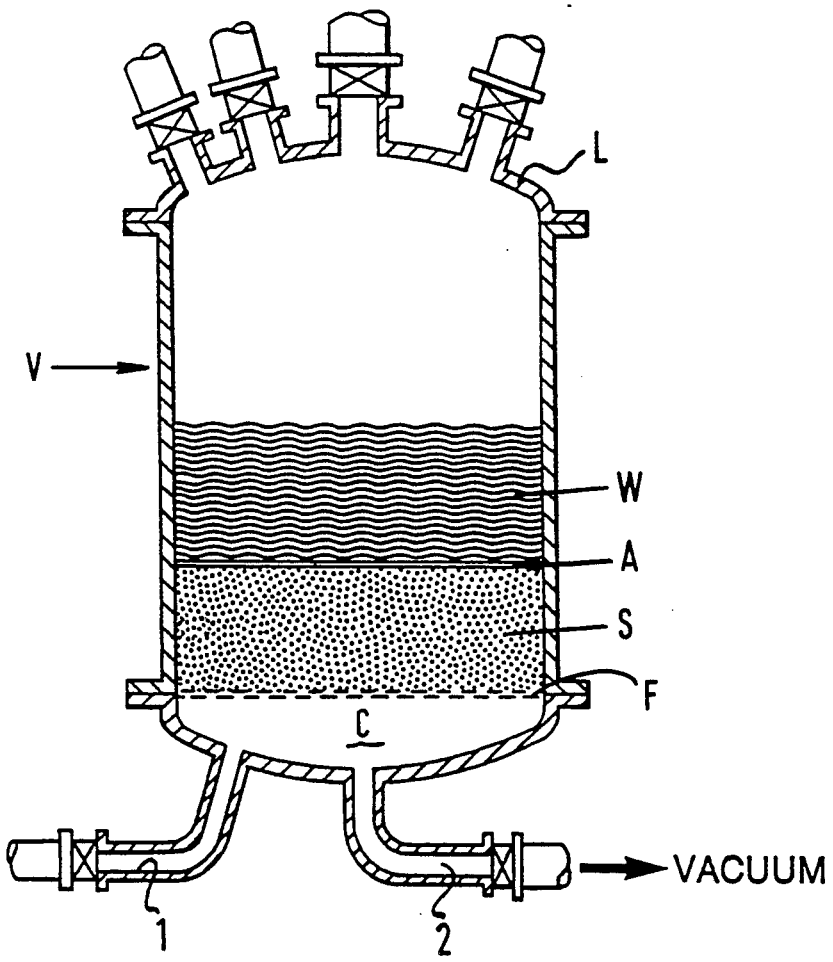
Figure 3:
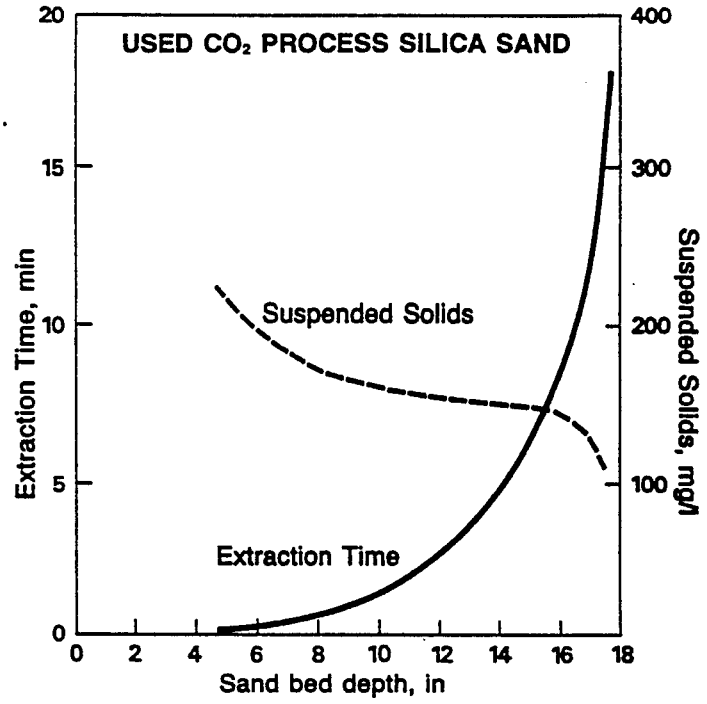
Figure 4:
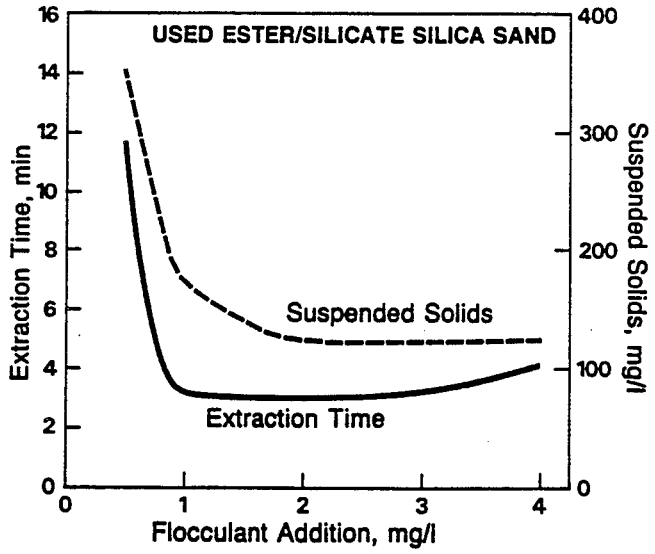
Figure 5:
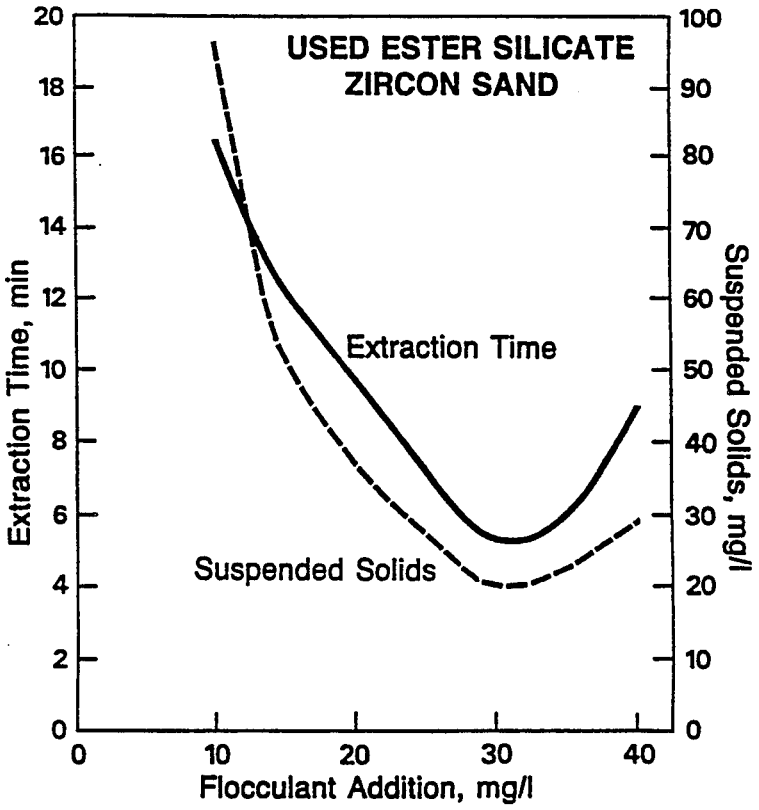
Figure 6:
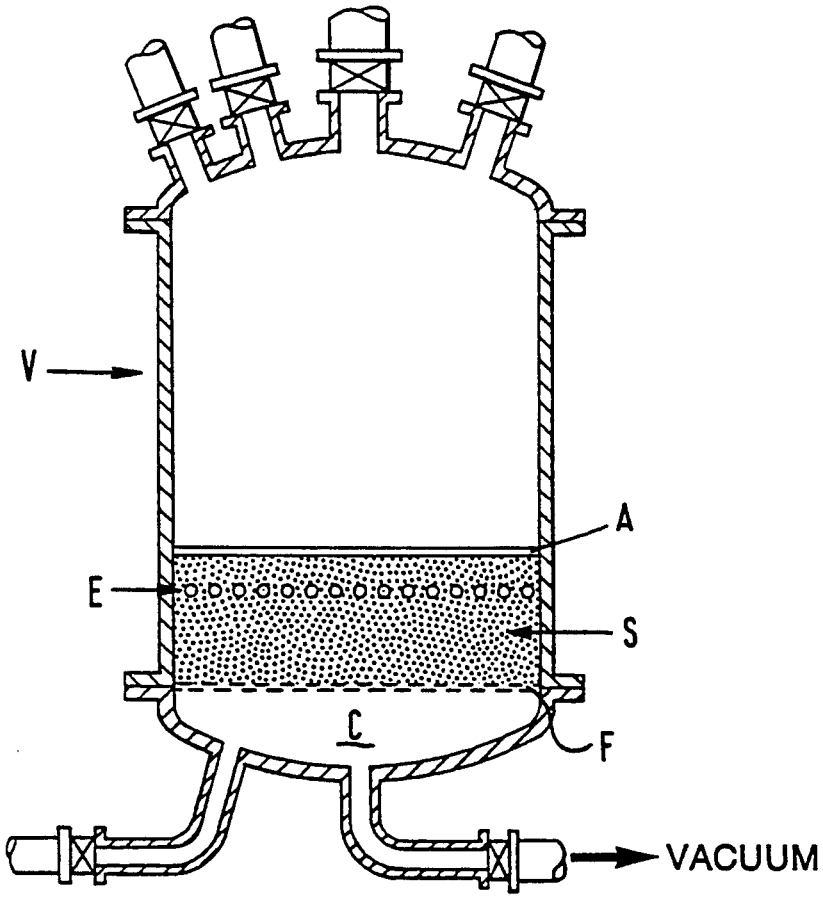

In order that the invention may be well understood, it will now be described, by way of illustration, with reference to the accompanying drawings, in which FIG. 1 is a vertical sectional view of a vessel which a sand/water mixture is being agitated, FIG. 2 is a view as FIG. 1 at a later stage; and FIGS. 3, 4 and 5 are graphs showing the relationship between different parameters in the case of the treatment of a silica sand and a zircon sand; and FIG. 6 is a view of FIG. 2 but of another vessel.

The same reference numerals are used to describe the different embodiments.

The vessel of FIG. 1 comprises a steel vessel V having a plenum chamber C at the base. The chamber C has roof in the form of a suspended floor F formed of a porous membrane, such as a stainless steel mesh. The chamber has an inlet and outlet, 1 and 2 respectively. The vessel has a lid L having four inlets 3, 4, 5 and 6. Each of the passages 1 to 6 has a valve 7.

In use, used sodium silicate bonded sand is crushed to grain size e.g. in a rotary drum attrition unit and the sand is then fed into the vessel via one of the inlets in the lid L. Water to which acid has been added is supplied via another inlet, in a sand:water weight ratio of about 1:2. A flocculant is also added via another inlet: for a silica sand a non-ionic flocculant of high molecular weight in a concentration of about 2mg/liter is preferred. Air is then blown upwards via the inlet 1 through the floor F to agitate the sand and water mixture to cause a scrubbing of the sand grains so removing soluble sodium derivatives. This is the condition shown in FIG. 1. After a period of minutes, the supply of air is switched off and the solids settle on the floor F. The relatively denser sand particles settle first to form a bed of sand S followed by finer particulate materials which because of the flocculant tend to form an agglomerated layer A of about 2 to 3 mm thick. The water W is on top. A vacuum is then applied to the vessel and the water is extracted via the plenum chamber C. This is the condition shown in FIG. 2. Because the water is drawn through the sand, the fine particles remain behind, so ensuring that the removed water has a suspended solids content below 500 mg/liter. The water may be drawn off over a period of about 3 minutes.

Fresh water is added to the vessel. The agitation is repeated followed by extraction of the water under vacuum. The sand may then be removed, dried, cooled and classified.

Our evaluations have shown that there is a relationship between the depth of the sand bed S, the level of suspended solids in the extracted water and the time to extract the water from the vessel V via the sand bed. FIG. 3 shows the relationship in the case of the reclamation of carbon dioxide gas hardened silicate bonded silica sand. The graph shows that an increase in the sand bed depth over about 6 inches (15 cm) increases the water extraction time but reduces the level of suspended solids in the extracted water. FIGS. 4 and 5 show the benefit of adding a flocculant to the water. In the case of FIG. 4, a nonionic flocculant of high molecular weight was added to the mixture of water and grains of a silicate sand which had been hardened and bonded using an ester/silicate system. As the graph of FIG. 4 shows, when the flocculant was present at about 2 mg/liter concentration the content of suspended solids was low; the extraction time fell to about 3 minutes. There was no value in increasing the proportion of the flocculant. In the case of reclaiming ester hardened silicate bonded zircon sand, and as shown in FIG. 5, with an increase in the rate of addition of a low molecular weight cationic flocculant both the extraction time and the content of suspended solids in the extracted water tend to fall to an optimum value after which a rise is observed. At about 30 mg/liter of flocculant the extraction time is reduced to about 5 minutes and the suspended solids content of the extracted water falls to about 20 mg/liter.

In the embodiment of FIG. 6, the vessel includes an array of heating elements E spaced above the floor F. In use, sand, acidified water and flocculant are introduced into the vessel; the mixture is agitated and the water is extracted. The elements E are energised, and a vacuum is drawn so that the sand is dried. The vacuum is removed and air supplied to fluidise the sand, and the air passed through the sand serves to blow away the fines. The sand is then cooled and blown out to a storage hopper for admixture with virgin sand.

The invention is illustrated by the following examples. Measurements were made of the soluble sodium oxide content of the sand and the pH and suspended solids content of the effluent. The measurements were made as follows.

The soluble sodium oxide content of the sand was measured by a method based on the procedure given by K Srinagesh, Chemistry of Sodium Silicate as a Binder, *AFS International Cast Metals Journal* 1979 4 (1) March 50–63, and as follows:

Reagent
0.1 N hydrochloric acid
Apparatus
Chemical balance sensitive to 10 mg
125 ml conical beakers
50 ml measuring cylinder
25 ml burette
Electric hot plate or Bunsen burner
Magnetic stirrer and stirring bars
pH meter
Method Boil for 5 minutes 10.00 g of dried sand in 50 ml of distilled water. Titrate the cooled solution to pH 4 with the 0.1N HCl noting the volume of acid required. Then Soluble $Na_2O = 0.031X$ ml of 0.1N HCl Prior to use, the pH meter should be calibrated in accordance with the maker's instructions.

The pH value of the effluent was measured as follows
Apparatus
Beakers, e.g. 250 ml capacity
Magnetic stirrer and stirring bars
pH meter
Method Stir the effluent for at least 5 minutes and note the pH value at short intervals until constant. Prior to use the pH meter should be calibrated in accordance with the maker's instructions.

The suspended solids content of the effluent was measured by a method adapted from the Yorkshire Water Authority test procedure YWA Method 190-01.

Reagent
5N nitric acid
Apparatus
Chemical balance sensitive to 0.2 mg
Drying oven (105° C.)
Beakers, e.g. 250 ml capacity
Dropping pipette
100 ml stoppered measuring cylinder
Magnetic stirrer and stirring bars
pH meter
Glass fibre filter papers, Whatman GF/C grade, 5.5 cm diameter
Two component Buchner funnel with sintered glass stem
Filter flask
Suction pump
Method Follow the procedure given above for determination of pH and then add the acid solution from the pipette until the pH is 7.0±0.2.

Insert a glass fibre filter paper into the funnel assembly and using a slight suction wash with 100 ml of distilled water. Place the filter paper on a larger diameter paper and dry at 105° C. for 1 hour. Allow the paper to cool in a desiccator for 5 minutes and then record the weight, $W_1$g.

Replace the paper in the funnel and moisten with distilled water. Shake the effluent vigorously and immediately transfer, by means of the measuring cylinder, a volume V ml into the funnel (normally, V=100 ml).

Filter under suction transferring any solids remaining in the measuring cylinder to the funnel with distilled water. Wash the residue three times with 10 ml of distilled water. Place the filter paper on a larger diameter paper and dry at 105° C. for 1 hour. Allow the paper to cool in a desiccator for 5 minutes and then record the weight, $W_2$g, of the paper plus the solids.

Then $$\text{Suspended solids content} = \frac{W_2 - W_1}{V} \times 10 \text{ mg/liter}$$

EXAMPLE 1

Different sands were treated in different ways to determine the effectiveness of the invention. The materials and conditions and results are shown in Table 1.

The material for Test 1 was $CO_2$ process sand dry reclaimed by a local foundry. The material for Tests 2 to 5 was knock out sand from silicate bonded moulds hardened by the $CO_2$ process and which had been crushed and passed through a sieve having openings about 1.0 mm mesh before being subject to the treatment specified. The soluble soda content was measured by the method above.

The wash waters were acidified using the acidifying agent shown. The materials were then treated as specified, the treated sand and wash waters being tested as shown. In the case of Test 2 where shown the wash waters were re-used; otherwise fresh wash water was used. The water was in weight ratio to the sand of 2:1 for Tests 1 to 4 and 1:1 for Test 5.

The results show that by using the wash water as specified the soluble sodium oxide content is dramatically reduced.

TABLE I

| No. | 1 | 2 | 3 | 4 | 5 |
|---|---|---|---|---|---|
| Material | $CO_2$ sand dry reclaimed | $CO_2$ sand, used and crushed to −1.0 mm | | | |
| Soluble soda content, % | 0.31 | 0.46 | 0.47 | 0.40 | 0.45 |
| Wash water | | | | | |
| acidifying agent | Concentrated hydrochloric acid | | | | |
| temperature °C. | 10 | 8.5 | 10 | 10 | 9 |
| Treatment No. 1 | | | | | |
| wash time, min | 5 | 5 | 5 | 10 | 5 |
| dewater time, min | 11.5 | 13.5 | 29.5 | 17 | 27 |
| soluble soda, % | 0.16 | 0.08 | 0.11 | 0.10 | 0.17 |
| wash water, pH | — | 2.0 | 9.4 | 11,1 | 8.5 |
| wash water solids, mg/l | 113 | 170 | 322 | 184 | 195 |
| Treatment No. 2 | | | | | |
| wash time, min | 5 | 5* | 5 | 5 | 5 |
| dewater time, min | 7 | 24 | 12 | 22 | 20 |
| soluble soda, % | 0.14 | 0.12 | 0.12 | 0.10 | 0.11 |

TABLE I-continued

| No. | 1 | 2 | 3 | 4 | 5 |
|---|---|---|---|---|---|
| wash water, pH | — | 10.6 | 10.4 | 10.6 | 10.2 |
| wash water solids, mg/l | 215 | 212 | 244 | 181 | 354 |
| Treatment No. 3 | | | | | |
| wash time, min | 5 | 5* | 5 | 5 | 5 |
| dewater time, min | 6 | 22 | 9 | 15 | 14 |
| soluble soda, % | 0.07 | 0.10 | 0.09 | 0.10 | 0.10 |
| wash water, pH | — | 10.4 | 9.8 | 10.0 | 10.4 |
| wash water solids, mg/l | 145 | 262 | 221 | 206 | 497 |
| Treatment No. 4 | | | | | |
| wash time, min | 5 | 5 | 5 | 5 | 5 |
| dewater time, min | 5 | 10 | 8 | 12 | 10 |
| soluble soda, % | 0.06 | 0.09 | 0.07 | 0.07 | 0.09 |
| wash water, pH | — | 9.8 | 10.0 | 11.4 | 10.5 |
| wash water solids, mg/l | 128 | 194 | 179 | 140 | 329 |

*was water re-used

In general, the content is reduced by about 80% in two washes of clean wash water. The cleaned sand can be used in admixture with low proportions of fresh sand. The waste water can be discharged to waste outlets because, in general, the solids in suspension measured at pH 7 is well below 500 mg/liter and the alkalinity is readily controllable to less than pH 10.

EXAMPLE II

Sands reclaimed in different ways were bonded with sodium silicate and hardened by the use of $CO_2$ gas.

The results are shown in Table II.

The results showed that unwashed sand and dry reclaimed sand gave poor gassed and short term standing strengths. The sands reclaimed according to the method of the invention gave results which were slightly below those for fresh sand but were nonetheless acceptable. In these tests no attempt was made to remove fines and their presence may have adversely affected the compressive strengths obtained in the last three results of Table II.

TABLE II

STRENGTH PROPERTIES OF SANDS ON REBONDING WITH 3% OF T12 SODIUM SILICATE (GASSED 5 l/MIN FOR 1 MIN)

| | Compression strength kN/m² | | | |
|---|---|---|---|---|
| Sand | As gassed | 3 h | 5 h | 24 h |
| Chelford 50 (new) | 625 | 2990 | 3440 | 5215 |
| Crushed Used $CO_2$ Sand - unwashed | 155 | 1320 | — | 2560 |
| Dry Reclaimed | 101 | 790 | 1180 | 3985 |
| Dry Reclaimed and Washed (Test 1) | 300 | 2560 | 2850 | 4445 |
| Crushed Used Sand Washed (Test 2) | 550 | 2655 | 3305 | 4585 |
| Crushed Used Sand Washed (Test 3) | 485 | 2430 | 2805 | 5130 |

I claim:

1. A method of reclaiming for re-use grains of silicate bonded particulate material including fine particles and sand comprising water-soluble binder products, comprising the steps of:

(a) placing an effective amount of water having a pH value below 10 and said particulate material in a vessel having a plenum chamber at the base and a suspended floor comprising a porous membrane, (b) subjecting the mixture to agitation for sufficient time to dissolve said soluble binder products off said particulate material, (c) stopping the agitation and leaving the unagitated mixture to allow the particulate material to settle on the porous membrane floor to form a bed comprising sand on the membrane and said fine particles on top of the said sand, (d) withdrawing the water with the soluble binder products therein from the vessel through the bed and causing said fine particles to be filtered out of asid water and retained on said bed, and (e) separating the fine particles from the sand after said water has been withdrawn.

2. A method according to claim 1 including the steps of:

(a) adding said water and said particulate material to the vessel in a weight ratio of about 1:1 to about 3:1, (b) withdrawing the water containing the soluble binder products from the material via the bed either under vacuum drawn through the porous membrane floor or by means of applied air pressure or both, (c) adding clean water to the bed of particulate material in a weight ratio of about 1:1, agitating the mixture for sufficient time to free residual soluble binder products from the particulate material, (d) withdrawing the water containing the residual soluble binder products from the material, and (e) drying and cooling the treated particulate material and removing said fine particles by air elutriation.

3. A method according to claim 2 including the step of providing a flocculant in the particulate material/water mixture.

4. A method according to claim 1 wherein heating elements are present in the vessel above the membrane so that they will be within the layer of the deposited particulate material, and, after withdrawing the water, energizing the heating elements and applying vacuum for drying the particulate material, and thereafter removing the vacuum and fluidizing the material for removing the fine particles to thereby provide dried and classified material ready for mixture with virgin particulate material.

5. A method according to claim 1 including the step of providing a flocculant in the particulate material/water mixture.

6. A method according to claim 5 wherein the used particulate material is a silica sand and about 1 or 2 mg/liter of a non-ionic flocculant of high molecular weight is included.

7. A method according to claim 5 wherein the used particulate material is a zircon sand and about 30 mg/liter of a low molecular weight cationic flocculant is included.

8. A method according to claim 5 wherein agitation is effected by applying compressed air to the mixture, at a pressure of about 2 to 30 lb/in$^2$ (0.14 to 2.07 bar) for a period ranging from about 5 to 20 minutes.

9. A method according to claim 5 wherein the step of withdrawing the water with the soluble binder products therein through the bed is carried out by applying a vacuum of the order of 15 inches Hg for a period of about 3 to 30 minutes.

10. A method according to claim 1 wherein the porous membrane has a pore size less than 75 $\mu$m.

11. A method according to claim 1 wherein the step of subjecting the mixture to agitation is effected by applying compressed air to the mixture, at a pressure of about 2 to 30 lb/in$^2$ (0.14 to 2.07 bar) for a period ranging from about 5 to 20 minutes.

12. A method according to claim 1 wherein the step of withdrawing the water with the soluble binder products therein through the bed is carried out by applying a vacuum of the order of 15 inches Hg for a period of about 3 to 30 minutes.

* * * * *